US010096941B2

(12) United States Patent
Ju

(10) Patent No.: US 10,096,941 B2
(45) Date of Patent: Oct. 9, 2018

(54) ELECTRICAL CONNECTOR

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/793,160

(22) Filed: Oct. 25, 2017

(65) Prior Publication Data

US 2018/0145460 A1 May 24, 2018

Related U.S. Application Data

(60) Provisional application No. 62/425,162, filed on Nov. 22, 2016.

(30) Foreign Application Priority Data

Dec. 28, 2016 (CN) ..... 2016 2 1450888 U

(51) Int. Cl.
*H01R 13/648* (2006.01)
*H01R 13/631* (2006.01)
(Continued)

(52) U.S. Cl.
CPC ..... *H01R 13/631* (2013.01); *H01R 13/501* (2013.01); *H01R 13/6581* (2013.01);
(Continued)

(58) Field of Classification Search
CPC ..... H01R 13/658; H01R 13/6581; H01R 13/6582; H01R 13/65802; H01R 13/6585;
(Continued)

(56) References Cited

U.S. PATENT DOCUMENTS 8,475,211 B2 * 7/2013 Wang ..... H01R 12/724 439/607.38
8,535,097 B2 * 9/2013 Yen ..... H01R 13/6594 439/607.27
8,790,138 B2 * 7/2014 Wang ..... H01R 27/02 439/607.4
8,968,033 B2 * 3/2015 Little ..... H01R 13/6581 439/607.35
9,011,178 B2 * 4/2015 Hori ..... H01R 13/6581 29/842
9,112,296 B2 * 8/2015 Zhang ..... H01R 13/516
9,425,560 B1 8/2016 Su et al.
9,608,391 B2 * 3/2017 Little ..... H01R 24/60
9,768,560 B2 * 9/2017 Yao ..... H01R 13/6594
(Continued)

FOREIGN PATENT DOCUMENTS

CN 205429247 U 8/2016
CN 205429271 U 8/2016
(Continued)

*Primary Examiner* — Michael A Lyons
*Assistant Examiner* — Milagros Jeancharles
(74) *Attorney, Agent, or Firm* — Locke Lord LLP; Tim Tingkang Xia, Esq.

(57) ABSTRACT

An electrical connector for the insertion of a mating connector. The electrical connector includes an insulating body having a base and a tongue extending forward from the base, multiple terminals fixed in the base and extending to the tongue, and a metal shell. The metal shell has two first walls along the upper side and the lower side, two second walls along the left side and the right side, and a limiting surface connected to the first walls and the second walls. When the mating connector is inserted in an insertion space, a first distance exists between each first wall and a shielding shell, a second distance exists between each second wall and the shielding shell, a third distance exists between each limiting surface and the shielding shell, and the third distance is less than the first distance and the second distance.

13 Claims, 14 Drawing Sheets

(51) Int. Cl.

| | |
|---|---|
| ***H01R 13/6581*** | (2011.01) |
| ***H01R 24/60*** | (2011.01) |
| ***H01R 13/50*** | (2006.01) |
| ***H01R 13/6582*** | (2011.01) |
| ***H01R 13/6585*** | (2011.01) |
| ***H01R 13/6594*** | (2011.01) |
| ***H01R 43/02*** | (2006.01) |
| *H01R 107/00* | (2006.01) |

(52) U.S. Cl.
CPC ..... *H01R 13/6582* (2013.01); *H01R 13/6585* (2013.01); *H01R 13/6594* (2013.01); *H01R 24/60* (2013.01); *H01R 43/0256* (2013.01); *H01R 2107/00* (2013.01)

(58) Field of Classification Search
CPC ..... H01R 13/6594; H01R 13/631; H01R 13/501; H01R 23/6873; H01R 23/7073; H01R 24/60; H01R 43/0256
USPC ..... 439/607.01, 607.27, 607.35, 607.4
See application file for complete search history.

(56) References Cited

U.S. PATENT DOCUMENTS

| | | | | |
|---|---|---|---|---|
| 9,954,319 | B2 * | 4/2018 | Zhao | H01R 13/6591 |
| 10,050,365 | B1 * | 8/2018 | Ju | H01R 13/02 |
| 2010/0093215 | A1 * | 4/2010 | Xiong | H01R 13/65802<br>439/607.19 |
| 2012/0231675 | A1 * | 9/2012 | Zhang | H01R 12/724<br>439/682 |

FOREIGN PATENT DOCUMENTS

| | | | |
|---|---|---|---|
| CN | 205429282 | U | 8/2016 |
| CN | 205509067 | U | 8/2016 |
| CN | 205509073 | U | 8/2016 |
| CN | 205543326 | U | 8/2016 |
| CN | 205543328 | U | 8/2016 |

* cited by examiner

ELECTRICAL CONNECTOR

CROSS-REFERENCE TO RELATED APPLICATIONS

This non-provisional application claims priority to and benefit of, pursuant to 35 U.S.C. § 119(e), U.S. provisional patent application Ser. No. 62/425,162, filed Nov. 22, 2016. This application also claims priority to and benefit of, under 35 U.S.C. § 119(a), Patent Application No. 201621450888.X filed in P.R. China on Dec. 28, 2016. The entire contents of the above-identified applications are incorporated herein by reference.

FIELD OF THE INVENTION

The present invention relates to an electrical connector, and more particularly to an interface type electrical connector.

BACKGROUND OF THE INVENTION

With the development of the electronic industry, the structural stability and transmission rate of existing input/output (I/O) electrical connector assemblies installed on circuit boards are increased gradually as well in order to meet the requirement of consumers. An existing electrical connector assembly includes a plug connector and a socket connector that fit with each other. The socket connector includes an insulating body, multiple conductive terminals received in the insulating body, and a metal shell wrapping the periphery of the insulating body. An insertion space is formed between the metal shell and the insulating body, and the multiple conductive terminals are located in the insertion space. The plug connector comprises a plastic body, multiple mating terminals fixed in the plastic body, and a shielding shell sleeving the plastic body. When the plug connector is inserted in the insertion space, the shielding shell is located in the metal shell, and the mating terminals are correspondingly in electrical contact with the multiple conductive terminals to form electrical connection. However, when in use by a user, the plug connector and the socket connector can easily encounter a problem of over-loose fit or over-tight fit. If the fit between the plug connector and the socket connector is over-loose, i.e., the clearance between the shielding shell and the metal shell is too big, the plug connector can easily shake at a high amplitude in the insertion space, and as a result, the fit between the plug connector and the socket connector is not steady, easily causing poor contact. If the fit between the plug connector and the socket connector is over-tight, i.e., interference can easily take place between the shielding shell and the metal shell, the plug connector cannot be easily pulled out, and moreover, in the process of insertion and pulling, the surface of the shielding shell can be easily worn; after frequent insertion and pulling, the wear of the shielding shell will become severer, even the plating of the surface of the shielding shell will be worn out, and as a result, the appearance and electrical performance of the shielding shell will be severely affected.

Therefore, a heretofore unaddressed need exists in the art to address the aforementioned deficiencies and inadequacies.

SUMMARY OF THE INVENTION

In one aspect, the present invention relates to an electrical connector that can be in steady fit with a mating connector and can be inserted and pulled out easily.

In certain embodiments, an electrical connector is used for insertion of a mating connector in dual orientation to form electrical connection. The mating connector has a shielding shell. The electrical connector includes an insulating body having a base and a tongue extending forward from the base, multiple terminals fixed in the base and extend to the tongue, and a metal shell fixed on the base. An insertion space is arranged between the metal shell and the tongue. The insertion space is used for receiving the mating connector. The metal shell is provided with two first walls arranged oppositely along the upper side and the lower side, two second walls arranged oppositely along the left side and the right side, and a limiting surface connected to one of the first walls and the corresponding second wall. When the mating connector is inserted in the insertion space, a first distance exists between each first wall and the shielding shell, a second distance exists between each second wall and the shielding shell, a third distance exists between each limiting surface and the shielding shell, and the third distance is less than the first distance and the second distance.

In certain embodiments, each limiting surface is a chamfer, and the chamfer forms the same angle with the corresponding the first wall and the second wall.

In certain embodiments, the four chamfers are arranged symmetrically relative to the horizontal central surface of the metal shell, and the third distance is the distance between the central point of each chamfer and the shielding shell.

In certain embodiments, each limiting surface includes a chamfer and a stopping portion protruding toward the insertion space from the chamfer. Both ends of the chamfer are respectively connected to the first wall and the second wall, the stopping portion is located on the central line of the chamfer, and the third distance exists between the stopping portion and the shielding shell.

In certain embodiments, each stopping portion is shaped like a long strip, and a spacing exists between the stopping portion and each of the front edge and rear edge of the chamfer.

In certain embodiments, a first chamfer and a second chamfer are connected with each other to form each limiting surface, one end of the first chamfer which is far from the second chamfer is connected to the first wall, and one end of the second chamfer which is far from the first chamfer is connected to the second wall. The angle between the first chamfer and the first wall is equal to the angle between the second chamfer and the second wall, and the third distance exists between each of the first chamfer and the second chamfer and the shielding shell.

In certain embodiments, the two first walls are respectively and horizontally arranged and are parallel to each other, the two second walls are respectively and vertically arranged and are parallel to each other, and the height of each of the first chamfer and the second chamfer in the vertical direction is greater than the height of the second wall.

In certain embodiments, each limiting surface includes an arc-shaped surface and at least one stopping portion protruding toward the insertion space from the arc-shaped surface, both ends of the arc-shaped surface are respectively connected to the first wall and the second wall, and the third distance exists between the stopping portion and the shielding shell.

In certain embodiments, each arc-shaped surface is provided with two stopping portions protruding toward the insertion space, the two stopping portions are respectively located at the joint between the arc-shaped surface and the first wall and the joint between the arc-shaped surface and the second wall, and the third distance exists between each stopping portion and the shielding shell.

In certain embodiments, each stopping portion is arc-shaped, and the distance between the stopping portion and the shielding shell is zero.

In certain embodiments, the electrical connector further includes an external metal shell which wraps the periphery of the metal shell. Both sides of the external metal shell are respectively provided with a fastening hole, both sides of the metal shell are respectively provided with an elastic piece corresponding to the fastening hole, each elastic piece is correspondingly fastened in each fastening hole, and the stopping portions are located in front of the elastic pieces.

In certain embodiments, the terminals are respectively arranged on the upper surface and lower surface of the tongue to form an upper row of terminal group and a lower row of terminal group, the upper row of terminal group and an upper insulating block are formed as a whole by embedding, the lower row of terminal group and a lower insulating block are formed as a whole by embedding, a shielding sheet is clamped between the upper insulating block and the lower insulating block, and the upper row of terminal group, the shielding sheet and the lower row of terminal group are fixed along with the insulating body as a whole in an embedding forming manner.

In certain embodiments, both sides of the tongue are respectively and concavely provided with a fastening slot, both sides of the shielding sheet are respectively and concavely provided with a recessed portion, and the recessed portions are correspondingly located at the fastening slots and aligned with each other in the vertical direction.

Compared with the related art, certain embodiments of the present invention have the following beneficial advantages: the metal shell is provided with the two first walls arranged oppositely along the upper side and the lower side, the two second walls arranged oppositely along the left side and the right side and the limiting surface located between each first wall and each second wall, that is, the four angles of the metal shell are all provided with the limiting surfaces; and when the mating connector is inserted in the insertion space, the first distance exists between each first wall and the shielding shell, the second distance exists between each second wall and the shielding shell, the third distance exists between each limiting surface and the shielding shell, the third distance is less than the first distance and the second distance, therefore the arrangement of the limiting surfaces makes the fit clearance between the metal shell and the shielding shell of the mating connector small, the limiting surfaces can simultaneously limit the mating connector from the upper and lower sides and the left and right sides, preventing the excessive displacement of the mating connector in the insertion space, consequently, the amplitudes of the vertical shaking and horizontal shaking of the mating connector in the insertion space are decreased, the fit between the electrical connector and the mating connector is steady, the stable electrical contact between the electrical connector and the mating connector is guaranteed, moreover, the mating connector can be inserted and pulled out easily, and the interference fit between the electrical connector and the mating connector which causes the wear of the shielding shell of the mating connector is prevented.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
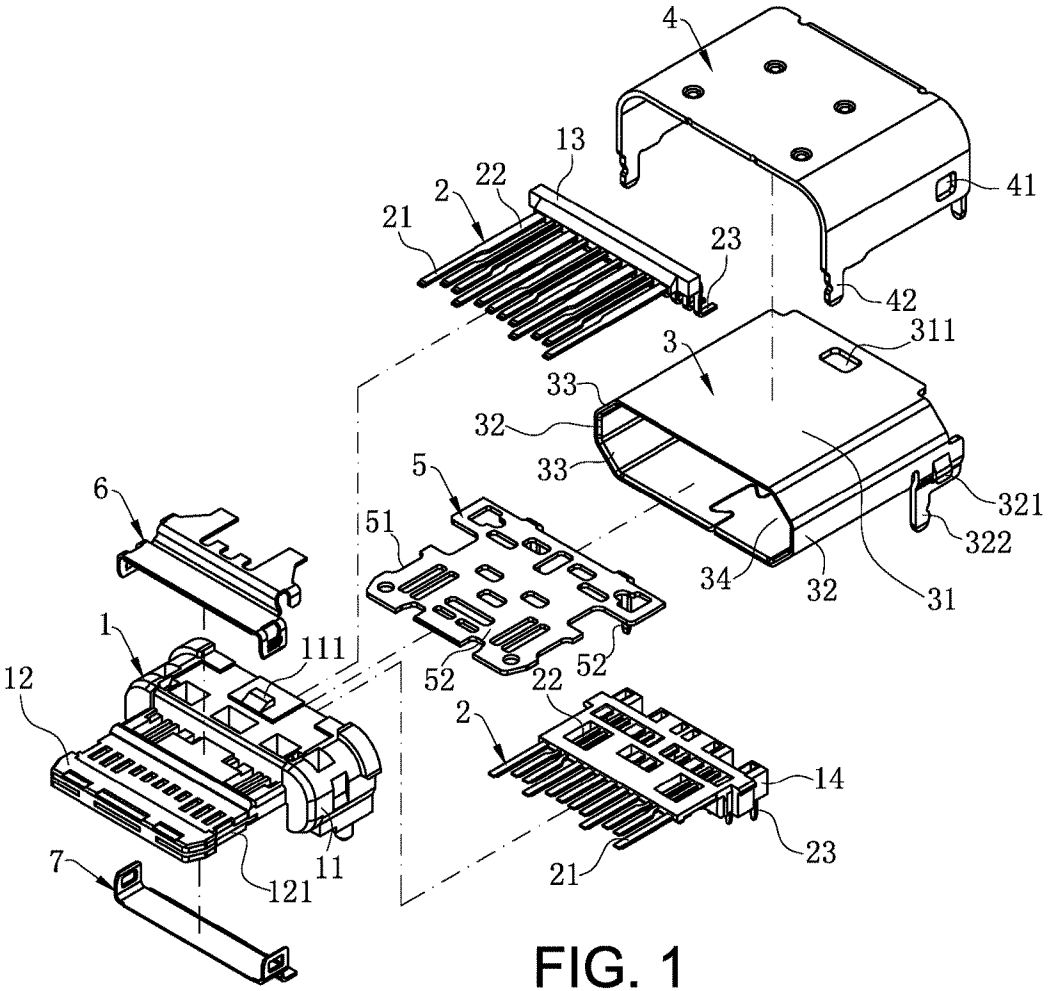
FIG. 1 is a three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector.

Figure 2:
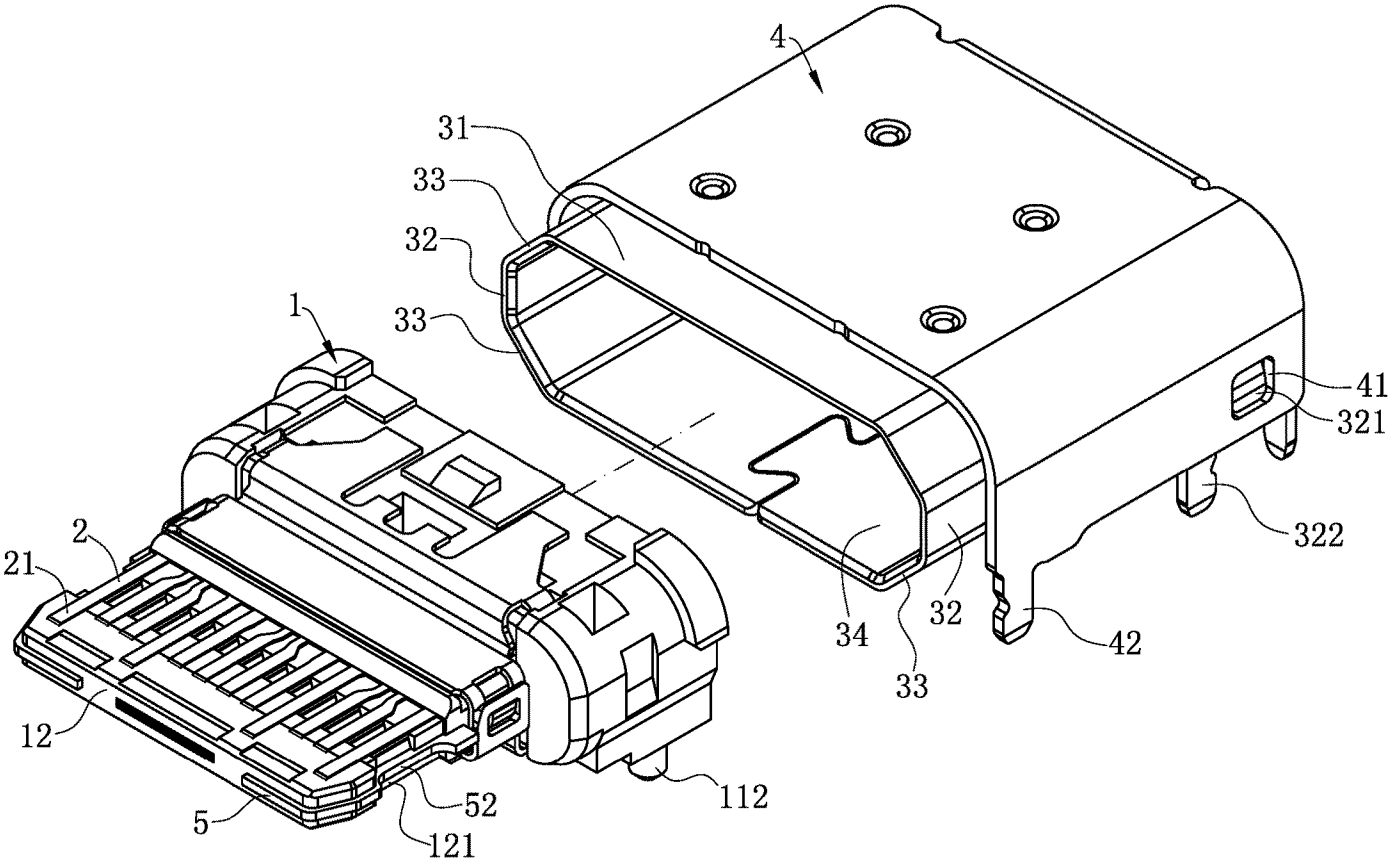
FIG. 2 is a partial assembly view of the electrical connector according to one embodiment of the present invention.
Figure 3:
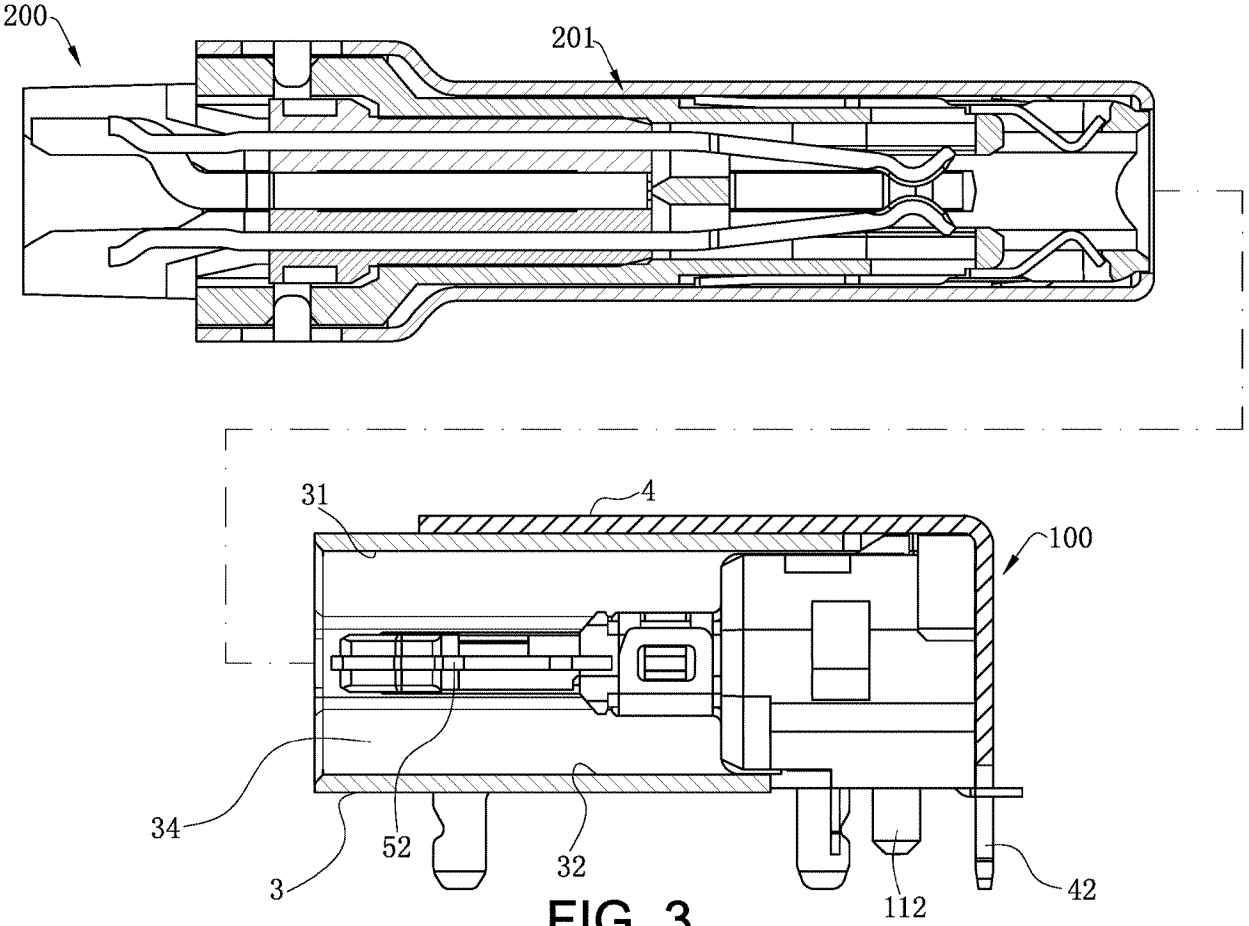
FIG. 3 is a schematic view of the electrical connector according to one embodiment of the present invention before mating with a mating connector.
Figure 4A:
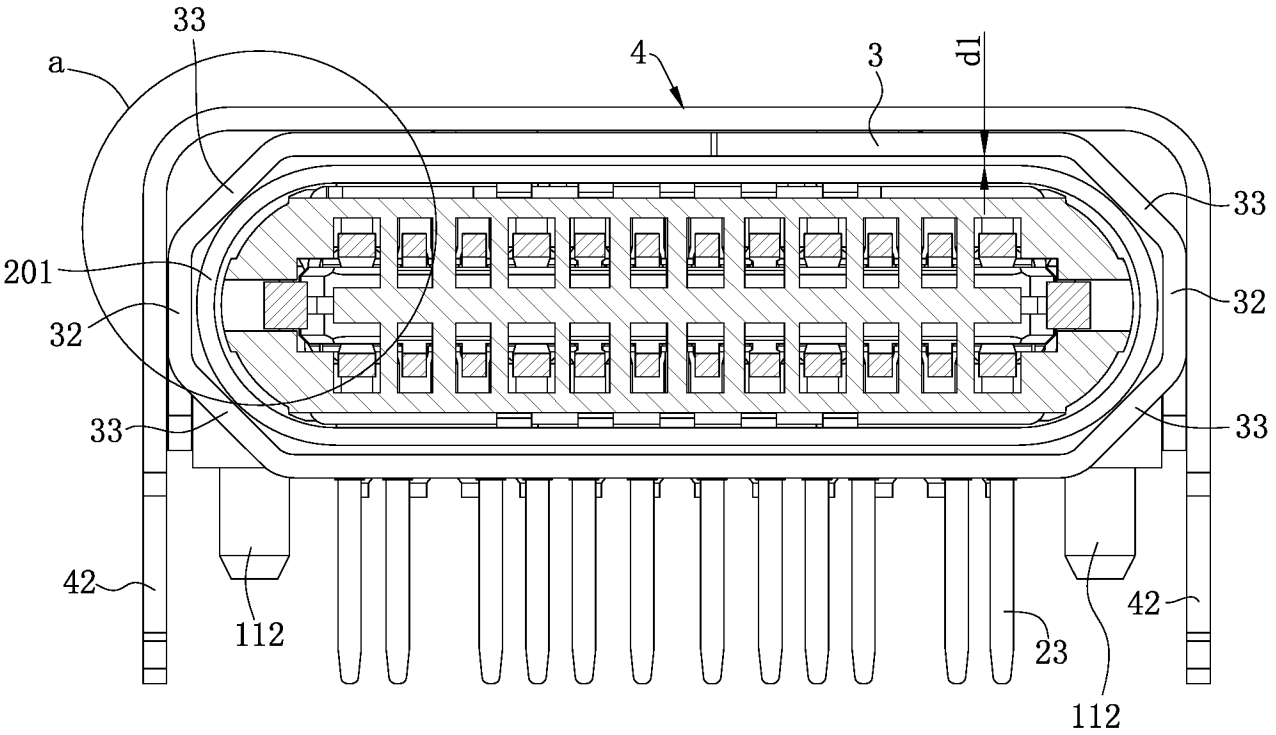
FIG. 4A is a front view of the electrical connector according to one embodiment of the present invention after mating with the mating connector.
Figure 4B:
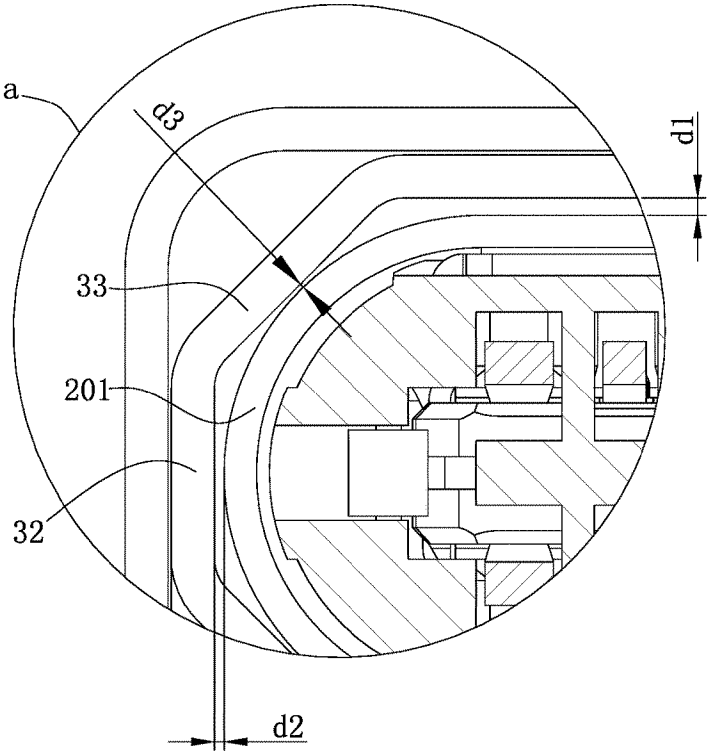
FIG. 4B is an enlarged view of a part a as shown in FIG. 4A.

Referring to FIGS. 1-3, an electrical connector 100 according to one embodiment of the present invention can be installed on an external circuit board (not shown), and can be fitted with a mating connector 200 by insertion. The mating connector 200 is provided with a plastic body (not labeled), multiple mating terminals (not labeled) received in the plastic body and a shielding shell 201 wrapping the plastic body. The electrical connector 100 includes an insulating body 1, multiple terminals 2 fixed in the insulating body 1, a shielding sheet 5 embedded in the insulating body 1, a metal shell 3 sleeving the insulating body 1, and an external metal shell 4 wrapping the metal shell 3. The multiple terminals 2 are used for being in electrical contact with the multiple mating terminals, and the inner wall of the metal shell 3 fits with the shielding shell 201.

Referring to FIGS. 1-3, the insulating body 1 includes a base 11 and a tongue 12 extending forward from the base 11. The thickness of the tongue 12 is less than the thickness of the base 11. The multiple terminals 2 and the insulating body 1 are fixed as a whole in an embedding forming manner. Both sides of the bottom surface of the base 11 are respectively and convexly provided with a positioning post 112. The positioning posts 112 are used for fixing the electrical connector 100 on the circuit board. A fastening block 111 upwardly protrudes from the top surface of the base 11. The distance from the top of the tongue 12 to the top wall of the metal shell 3 is equal to the distance from the bottom of the tongue 12 to the bottom wall of the metal shell 3, so that the mating connector 200 can be inserted into the insertion space 34 in dual orientation to mate with the electrical connector 100, and can transmit signals. Both sides of the tongue 12 are respectively and concavely provided with a buckling slot 121, which is used for buckling the mating connector 200.

Referring to FIGS. 1-3, the terminals 2 are arranged separately and at intervals. The terminals 2 are respectively arranged on the upper surface and lower surface of the tongue 12 to form an upper row of terminal group and a lower row of terminal group. The upper row of terminal group and an upper insulating block 13 are formed as a whole by embedding, the lower row of terminal group and a lower insulating block 14 are formed as a whole by embedding, and the shielding sheet 5 is clamped between the upper insulating block 13 and the lower insulating block 14, and is used for shielding the signal interference between the upper row of terminal group and the lower row of terminal group. The upper row of terminal group, the shielding sheet 5 and the lower row of terminal group are fixed along with the insulating body 1 as a whole in an embedding forming manner. Each terminal 2 in the upper row of terminal group and the lower row of terminal group is provided with a flat contacting portion 21 which is exposed to the surface of the tongue 12, and the contacting portions 21 are used for being in electrical contact with the mating terminals. The contacting portions 21 of the upper row of terminal group are exposed to the upper surface of the tongue 12, and the contacting portions 21 of the lower row of terminal group are exposed to the lower surface of the tongue 12. Each terminal 2 is further provided with a soldering portion 23 and a connecting portion 22 connected with the contacting portion 21 and the soldering portion 23. The soldering portions 23 extend out of the bottom surface of the base 11, and the connecting portions 22 are embedded in the base 11 to fix the terminals 2 in the insulating body 1. The soldering portions 23 of the terminals 2 located at the upper row are soldered to the circuit board in a surface soldering manner, the soldering portions 23 of the terminals 2 located at the lower row are soldered to the circuit board in a through hole soldering manner, the periphery of the soldering portion 23 of each of the terminals 2 located at the lower row is wrapped by an insulating protruding block (not labeled), and the insulating protruding blocks are used for positioning the soldering portions 23, preventing the soldering portions 23 from skewing.

Referring to FIGS. 1-3, the shielding sheet 5 and the terminals 2 are formed along with the insulating body 1 as a whole by embedding. The front edge of the shielding sheet 5 protrudes beyond the front end of the tongue 12, and the side edges of the shielding sheet 5 protrude beyond the side edges of the tongue 12. Two recessed portions 51 are respectively recessed from both sides of the shielding sheet 5. The recessed portions 51 are correspondingly located at the buckling slots 121 and aligned with each other in the vertical direction. The shielding sheet 5 is provided with a horizontal first covering portion 52 that is located between the two rows of contacting portions 21, and is used for shielding the signal interference between the two rows of contacting portions 21. The electrical connector 100 may further include an upper shielding sheet 6 and a lower shielding sheet 7. The upper shielding sheet 6 is installed on the upper surface of the insulating body 1 and used for shielding interference signals over the upper row of terminal group, the lower shielding sheet 7 is installed on the lower surface of the insulating body 1 and used for shielding interference signals under the lower row of terminal group, and thereby it can be ensured that the multiple terminals 2 can transmit high-frequency signals.

Referring to FIGS. 1, 3, 4A and 4B, the metal shell 3 wraps the periphery of the insulating body 1. The metal shell 3 is made of stainless steel material. The metal shell 3 is fixed on the base 11. An insertion space 34 is arranged between the metal shell 3 and the tongue 12, and the insertion space 34 is used for receiving the mating connector 200. The metal shell 3 is provided with two first walls 31 arranged oppositely along the upper side and the lower side, two second walls 32 arranged oppositely along the left side and the right side and a limiting surface 33 connected to each first wall 31 and each second wall 32. The two first walls 31 are respectively and horizontally arranged and are parallel to each other. The two second walls 32 are respectively and vertically arranged and are parallel to each other. The limiting surface 33 is arranged between each first wall 31 and the corresponding second wall 32. Therefore the four corners of the metal shell 3 are all provided with the limiting surfaces 33. The two first walls 31, the two second walls 32 and the four limiting surfaces 33 jointly define the insertion space 34 along with the outer surface of the tongue 12. When the mating connector 200 is inserted in the insertion space 34, a first distance d1 exists between each first wall 31 and the shielding shell 201, a second distance d2 exists between each second wall 32 and the shielding shell 201, the second distance d2 is less than the first distance d1, a third distance d3 exists between each limiting surface 33 and the shielding shell 201, the third distance d3 is the minimum distance between the limiting surface 33 and the shielding shell 201. The third distance d3 is less than the first distance d1 and the second distance d2, therefore the arrangement of the limiting surfaces 33 makes the fit clearance between the metal shell 3 and the shielding shell 201 of the mating connector 200 small. The limiting surfaces 33 can simultaneously limit the mating connector 200 from the upper and lower sides and the left and right sides, preventing the excessive displacement of the mating connector 200 in the insertion space 34. Consequently, the amplitudes of the vertical shaking and horizontal shaking of the mating connector 200 in the insertion space 34 are decreased, the fit between the electrical connector 100 and the mating connector 200 is steady, the stable electrical contact between the electrical connector 100 and the mating connector 200 is guaranteed. Further, the mating connector 200 can be inserted and pulled out easily, and the interference fit between the electrical connector 100 and the mating connector 200 which causes the wear of the shielding shell 201 of the mating connector 200 is also prevented.

Referring to FIGS. 1, 2, 4A and 4B, the limiting surface 33 is a chamfer connected between the first wall 31 and the second wall 32. That is, in the present embodiment, the limiting surfaces 33 are the chamfers. The angle between the chamfer and the first wall 31 is equal to the angle between the chamfer and the second wall 32. The angle is 150 degrees in the present embodiment and is not limited thereto. The third distance d3 is the distance between the position of the central point of the chamfer and the shielding shell 201. The four corners of the metal shell 3 are all provided with the chamfers. Consequently, the mating connector 200 can be prevented from being inclined toward one side to collide with the terminals 2 when inserted, the mating connector 200 can be always kept horizontal in the process of insertion, and therefore the chamfers can effectively guide the mating connector 200 to be smoothly inserted into the insertion space 34. The four chamfers are arranged symmetrically relative to the horizontal central surface of the metal shell 3. Consequently, the mating connector 200 can be inserted in any one of the dual orientations into the insertion space 34, it is prevented that the mating connector 200 cannot be inserted in either direction due to the chamfers arranged on the metal shell 3, and the use of users is prevented from being affected. A first soldering pin 322 extends downward from each second wall 32 of the metal shell 3 and is used for being soldered onto the circuit board. The rear side of the metal shell 3 is provided with a fastening opening 311 which is used for being fastened with the fastening block 111.

Referring to FIGS. 1-3, the electrical connector 100 further includes an external metal shell 4. The external metal shell 4 wraps the periphery of the metal shell 3. The structures of the external metal shell 4 and the metal shell 3 complement each other, and thereby the shielding effect and strength of the electrical connector 100 can be enhanced. The first walls 31 of the upper side of the metal shell 3 are fixed on the external metal shell 4 by spot welding, the second walls 32 of both sides of the metal shell 3 are respectively provided with an elastic piece 321, both sides of the external metal shell 4 are respectively provided with a fastening hole 41, the elastic pieces 321 are fastened with the fastening holes 41, and thereby the metal shell 3 and the external metal shell 4 are fixed firmly. Two second soldering pins 42 extend downward from each of both sides of the external metal shell 4 and are used for being soldered fixedly on the circuit board, and the first soldering pins 322 are located between the two second soldering pins 42.

Referring to FIGS. 1, 2, 4A and 4B, during assembly, the upper row of terminal group and the upper insulating block 13 are first formed as a whole by embedding, the lower row of terminal group and the lower insulating block 14 are formed as a whole by embedding, the shielding sheet 5 is clamped between the upper insulating block 13 and the lower insulating block 14. The upper row of terminal group, the shielding sheet 5 and the lower row of terminal group are then fixed as a whole along with the insulating body 1 in an embedding forming manner. The upper shielding sheet 6 is installed on the upper surface of the insulating body 1, and the lower shielding sheet 7 is installed on the lower surface of the insulating body 1. Further, the first walls 31 of the metal shell 3 are fixed on the top surface of the external metal shell 4 by spot welding, the elastic pieces 321 of the second walls 32 of the metal shell 3 are fastened into the fastening holes 41 of the external metal shell 4. Finally, the metal shell 3 and the external metal shell 4 which are fixed as a whole forwardly sleeve the insulating body 1 from the base 11, so that the insertion space 34 is formed. The fastening opening 311 of the rear side of the metal shell 3 is fastened with the fastening block 111, so that the metal shell 3 is fixed on the base 11, and thereby the assembly of the electrical connector 100 is completed. When the mating connector 200 is inserted into the insertion space 34 from the front to the rear, the four chamfers jointly guide the mating connector 200 to be horizontally inserted into the insertion space 34 to be in electrical contact with the multiple contacting portions 21, the third distance d3 exists between each of the four chamfers and the shielding shell 201, so that the four limiting surfaces 33 limit the mating connector 200 in the vertical direction and the horizontal direction, and thereby stable electrical connection is formed between the mating connector 200 and the electrical connector 100.

Figure 5:
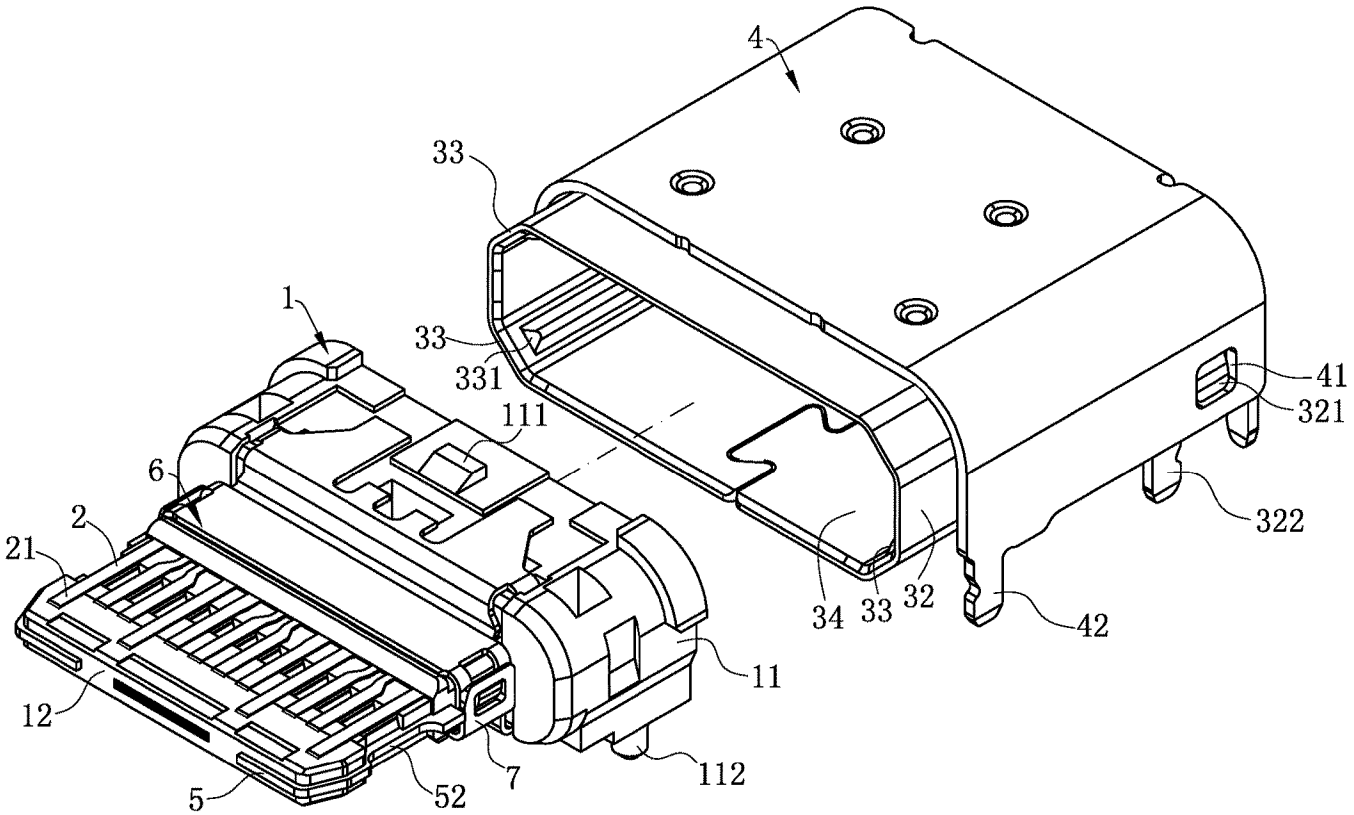
FIG. 5 is a partial assembly view of the electrical connector of a second embodiment of the present invention.
Figure 6A:
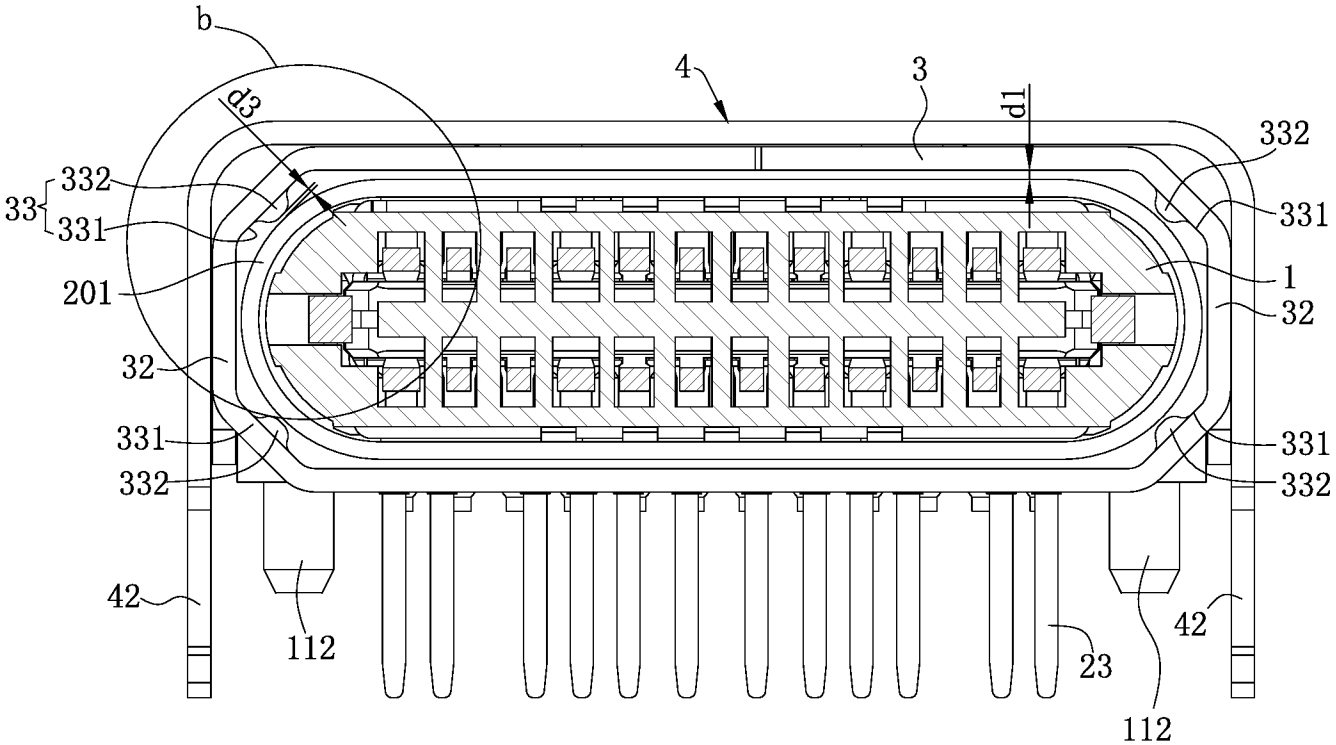
FIG. 6A is a front view of the electrical connector of a second embodiment of the present invention after mating with the mating connector.
Figure 6B:
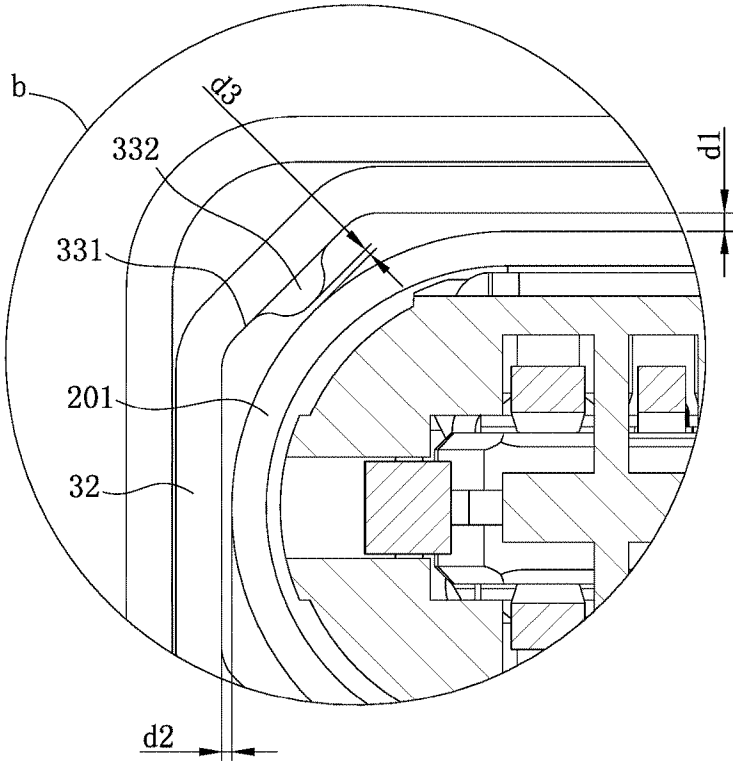
FIG. 6B is an enlarged view of a part b as shown in FIG. 6A.

FIGS. 5, 6A and 6B show a second embodiment of the present invention. The second embodiment differs from the first embodiment as follows: each limiting surface 33 includes a chamfer 331 and a stopping portion 332 protruding toward the insertion space 34 from the chamfer 331. Both ends of the chamfer are respectively connected to the first wall 31 and the second wall 32. The third distance d3 is not arranged between the chamfer 331 and the shielding shell 201, and the third distance d3 exists between the stopping portion 332 and the shielding shell 201. The stopping portion 332 is located on the central line of the chamfer 331. The stopping portion 332 is shaped like a long strip. The surface of the stopping portion 332 is a cambered surface. A spacing exists between the stopping portion 332 and each of the front edge and rear edge of the chamfer 331, and thereby punching force is prevented from deforming the front edge of the metal shell 3 during punching to affect the insertion of the mating connector 200 when the stopping portions 332 are formed by punching. Since there are four limiting surfaces 33, that is, there are four stopping portions 332 which are respectively located at the four corners of the metal shell 3, the third distance d3 exists between the surface of each stopping portion 332 and the shielding shell 201, the stopping portions 332 arranged on the limiting surfaces 33 can also simultaneously limit the mating connector 200 from the upper and lower sides and the left and right sides, so that the objective of decreasing the amplitudes of the vertical shaking and horizontal shaking of the mating connector 200 in the insertion space 34 can be achieved.

Figure 7A:
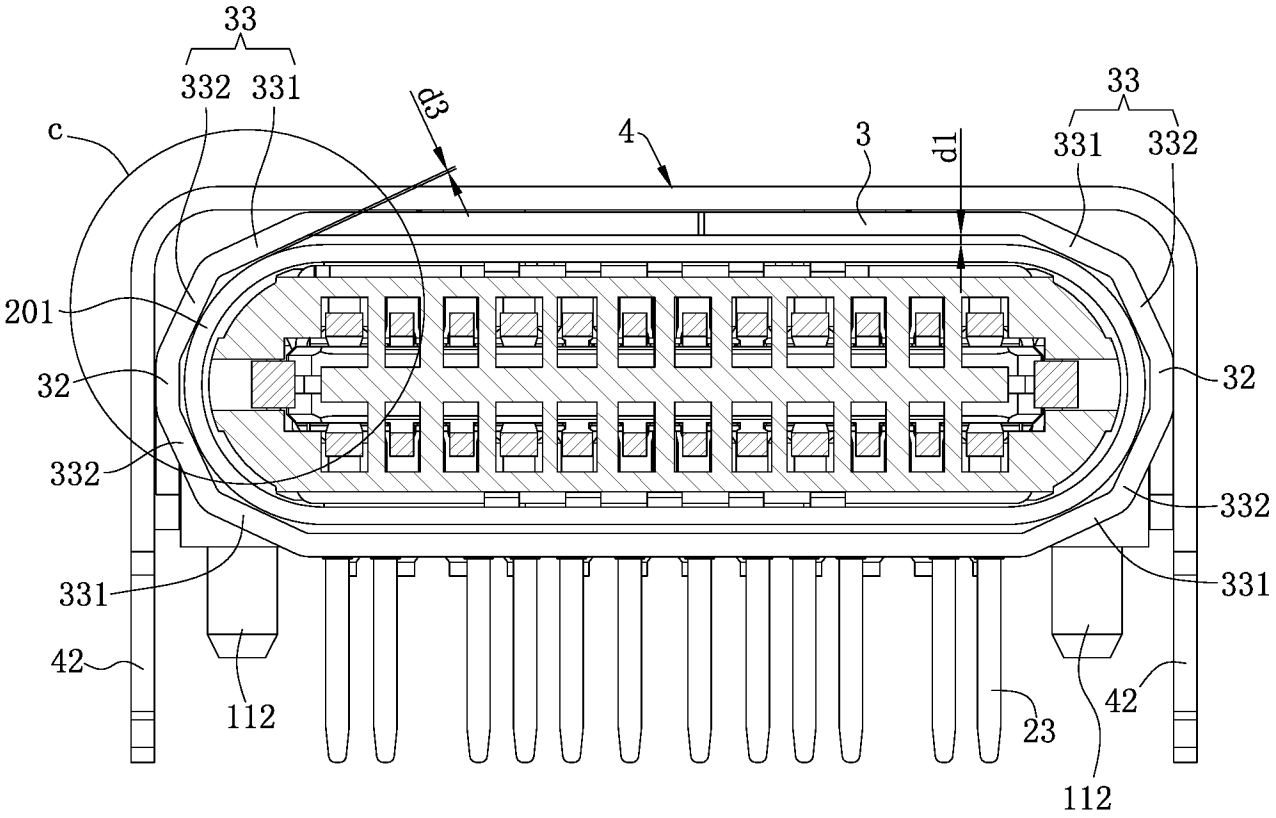
FIG. 7A is a front view of the electrical connector of a third embodiment of the present invention after mating with the mating connector.
Figure 7B:
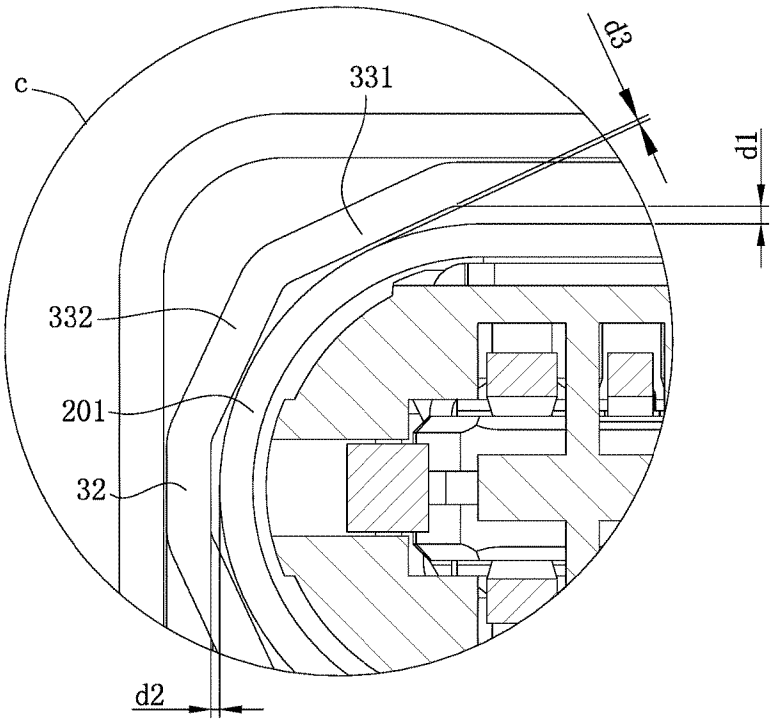
FIG. 7B is an enlarged view of a part c as shown in FIG. 7A.

FIGS. 7A and 7B show a third embodiment of the present invention. The third embodiment differs from the first embodiment as follows: a first chamfer 331 and a second chamfer 332 are connected with each other to form each limiting surface 33, one end of the first chamfer 331 which is far from the second chamfer 332 is connected to the first wall 31, one end of the second chamfer 332 which is far from the first chamfer 331 is connected to the second wall 32. The angle between the first chamfer 331 and the first wall 31 is equal to the angle between the second chamfer 332 and the second wall 32, and the third distance d3 exists between each of the first chamfer 331 and the second chamfer 332 and the shielding shell 201. The heights of both the first chamfer 331 and the second chamfer 332 in the vertical direction are greater than the height of the second wall 32. Since there are four limiting surfaces 33, the metal shell 3 is provided with the four first chamfers 331 and the four second chamfers 332. The third distance d3 exists between each of the first chamfers 331 and the second chamfers 332 and the shielding shell 201, so that the metal shell 3 can limit the shielding shell 201 in multiple directions, and thereby the mating connector 200 can be better limited from the upper and lower sides and the left and right sides, so that the objective of decreasing the amplitudes of the vertical shaking and horizontal shaking of the mating connector 200 in the insertion space 34 can be achieved.

Figure 8A:
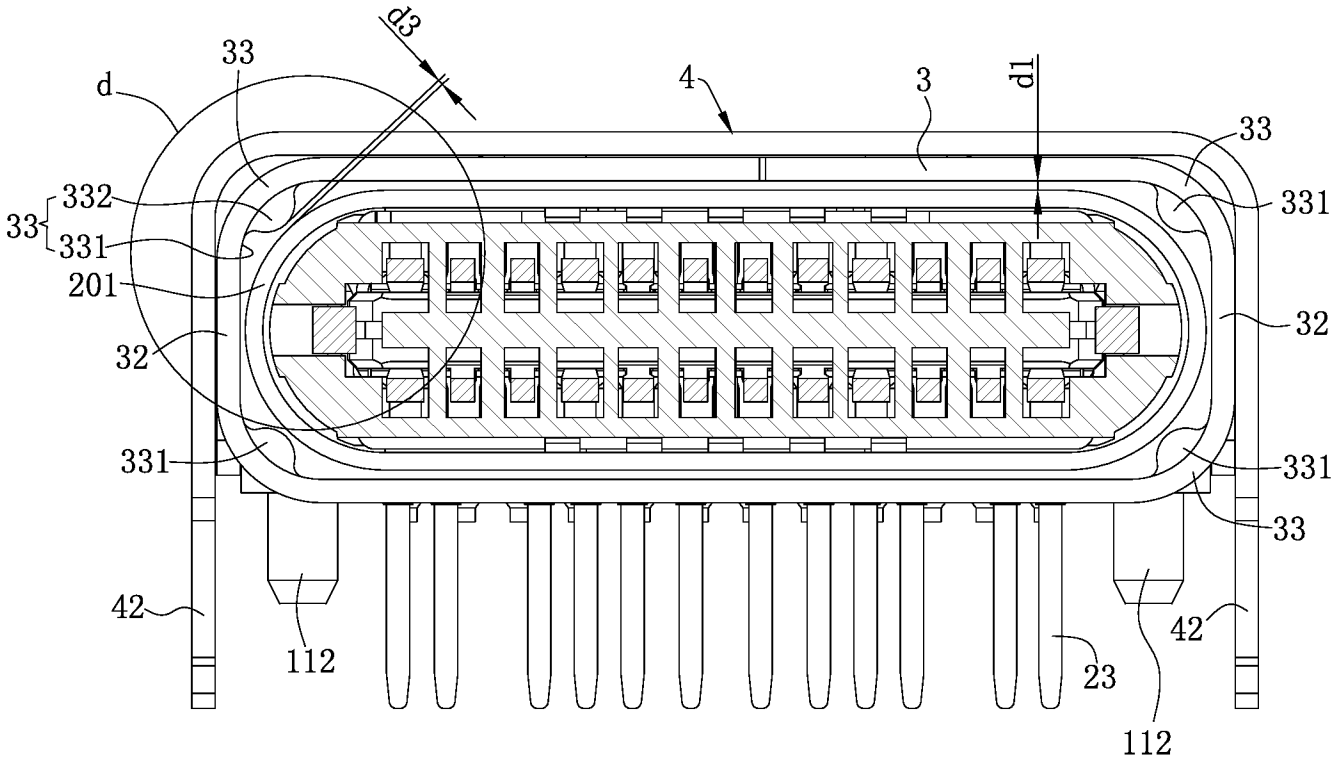
FIG. 8A is a front view of the electrical connector of a fourth embodiment of the present invention after mating with the mating connector.
Figure 8B:
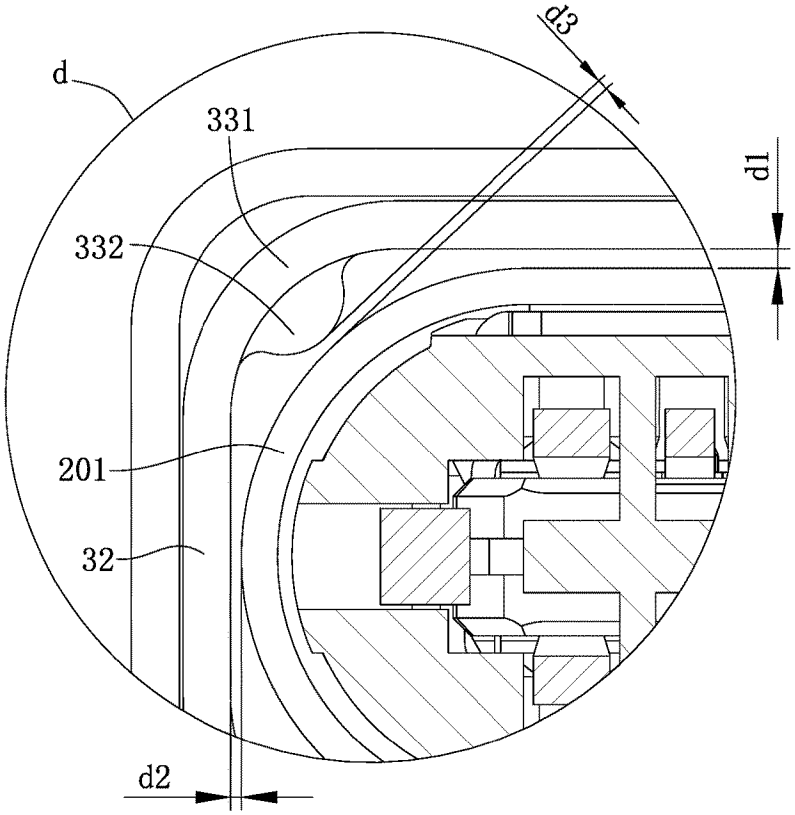
FIG. 8B is an enlarged view of a part d as shown in FIG. 8A.

FIGS. 8A and 8B show a fourth embodiment of the present embodiment. The fourth embodiment differs from the first embodiment as follows: each limiting surface 33 has an arc-shaped surface 331 and a stopping portion 332 protruding toward the insertion space 34 from the arc-shaped surface 331. The third distance d3 is the distance between the stopping portion 332 and the shielding shell 201. The surface of the stopping portion 332 is a cambered surface. A spacing exists between the stopping portion 332 and each of the front edge and rear edge of the arc-shaped surface 331. Thereby punching force is prevented from deforming the front edge of the metal shell 3 during punching to affect the insertion of the mating connector 200 when the stopping portions 332 are formed by punching. Since there are four limiting surfaces 33, that is, there are four stopping portions 332 which are respectively located at the four corners of the metal shell 3, the third distance d3 exists between the surface of each stopping portion 332 and the shielding shell 201, the arc-shaped surfaces 331 and the stopping portions 332 arranged on the limiting surfaces 33 can also simultaneously limit the mating connector 200 from the upper and lower sides and the left and right sides, so that the objective of decreasing the amplitudes of the vertical shaking and horizontal shaking of the mating connector 200 in the insertion space 34 can be achieved.

Figure 9A:
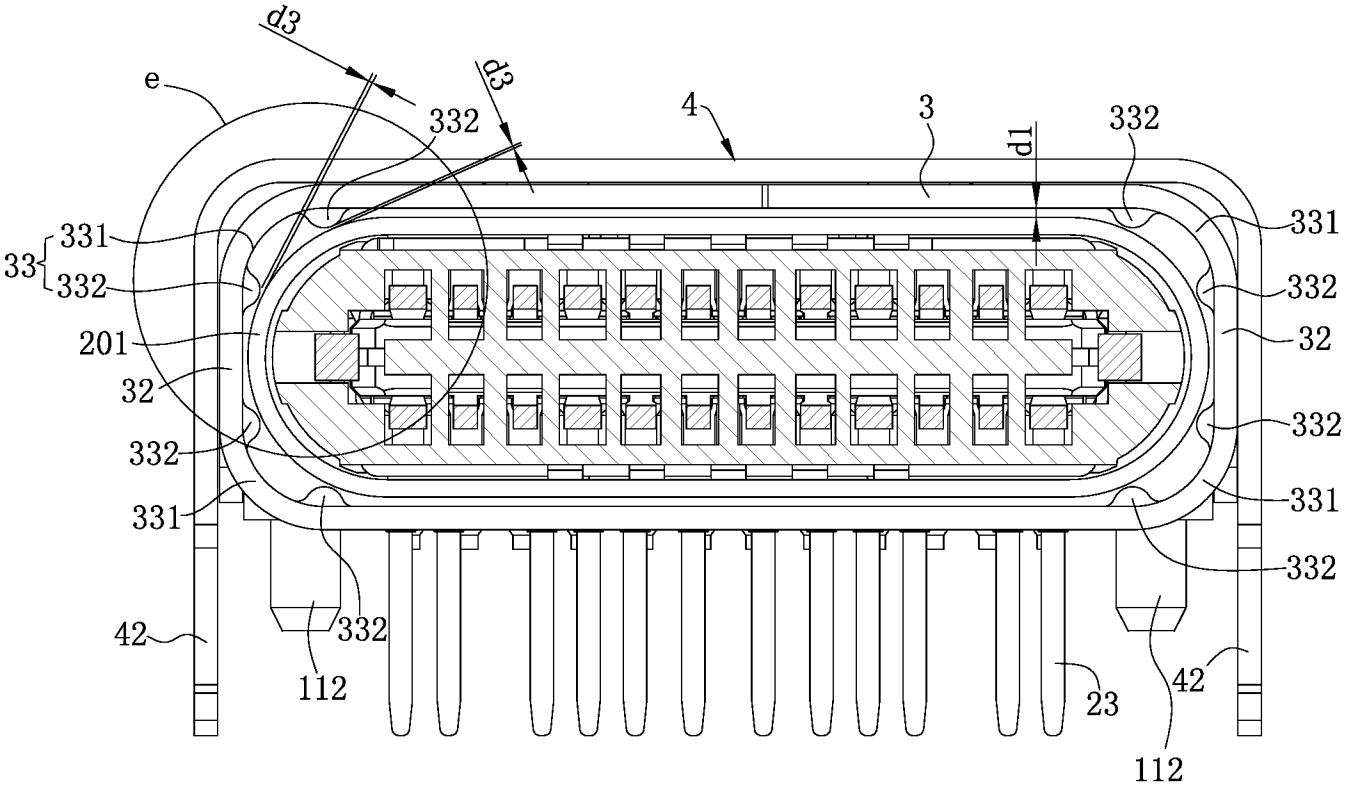
FIG. 9A is a front view of the electrical connector of a fifth embodiment of the present invention after mating with the mating connector.
Figure 9B:
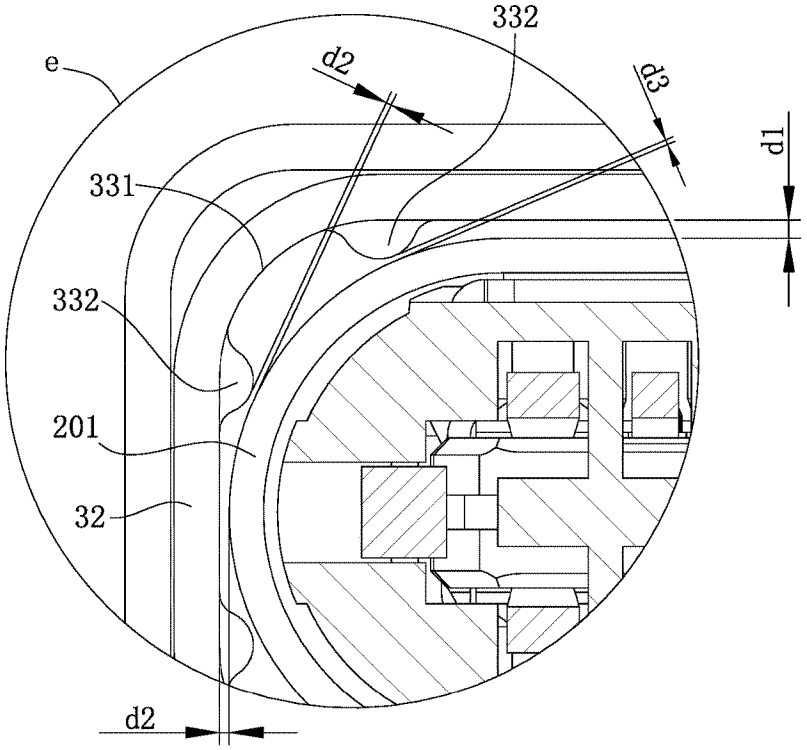
FIG. 9B is an enlarged view of a part e as shown in FIG. 9A.

FIGS. 9A and 9B shows a fifth embodiment of the present invention. The fifth embodiment differs from the first embodiment as follows: each limiting surface 33 has an arc-shaped surface 331 and two stopping portions 332 protruding toward the insertion space 34 from the arc-shaped surface 331. The two stopping portions 332 are respectively located at the joint between the arc-shaped surface 331 and the first wall 31 and the joint between the arc-shaped surface 331 and the second wall 32, the third distance d3 exists between each stopping portion 332 and the shielding shell 201, and the stopping portion 332 is arc-shaped. In the present embodiment, each arc-shaped surface 331 is provided with two stopping portions 332. In the other embodiments, there can be multiple stopping portions 332. In the present embodiment, the third distance d3 between the stopping portion 332 and the shielding shell 201 is zero. In the other embodiments, the distance between the stopping portion 332 and the shielding shell 201 can be non-zero, as long as it is ensured that the third distance d3 between the stopping portion 332 and the shielding shell 201 is greater than the first distance d1 and the second distance d2. Since the metal shell 3 is provided with the four arc-shaped surfaces 331 while each arc-shaped surface 331 is provided with the two stopping portions 332, that is, the metal shell 3 is provided with the eight stopping portions 332 which all match with the shielding shell 201, moreover, the third distance d3 exists between the surface of each stopping portion 332 and the shielding shell 201. Consequently, the metal shell 3 can limit the shielding shell 201 in multiple directions, and thereby the mating connector 200 can be better limited from the upper and lower sides and the left and right sides, so that the objective of decreasing the amplitudes of the vertical shaking and horizontal shaking of the mating connector 200 in the insertion space 34 can be achieved.

In summary, the electrical connector 100 according to certain embodiment of the present invention has the following beneficial advantages:

(1) When the mating connector 200 is inserted in the insertion space 34, a first distance d1 exists between each first wall 31 and the shielding shell 201, a second distance d2 exists between each second wall 32 and the shielding shell 201, the second distance d2 is less than the first distance d1, a third distance d3 exists between each limiting surface 33 and the shielding shell 201, the third distance d3 is the minimum distance between the limiting surface 33 and the shielding shell 201, the third distance d3 is less than the first distance d1 and the second distance d2. Therefore the arrangement of the limiting surfaces 33 makes the fit clearance between the metal shell 3 and the shielding shell 201 of the mating connector 200 small, the limiting surfaces 33 can simultaneously limit the mating connector 200 from the upper and lower sides and the left and right sides, preventing the excessive displacement of the mating connector 200 in the insertion space 34. Consequently, the amplitudes of the vertical shaking and horizontal shaking of the mating connector 200 in the insertion space 34 are decreased, the fit between the electrical connector 100 and the mating connector 200 is steady, the stable electrical contact between the electrical connector 100 and the mating connector 200 is guaranteed. Moreover, the mating connector 200 can be inserted and pulled out easily, and the interference fit between the electrical connector 100 and the mating connector 200 which causes the wear of the shielding shell 201 of the mating connector 200 is also prevented.

(2) The limiting surface 33 is a chamfer, the angle between the chamfer and the first wall 31 is equal to the angle between the chamfer and the second wall 32, the four corners of the metal shell 3 are all provided with the chamfers, consequently, the mating connector 200 can be prevented from being inclined toward one side to collide with the terminals 2 when inserted, the mating connector 200 can be always kept horizontal in the process of insertion, and therefore the chamfers can effectively guide the mating connector 200 to be smoothly inserted into the insertion space 34.

(3) The four chamfers are arranged symmetrically relative to the horizontal central surface of the metal shell 3, consequently, the mating connector 200 can be inserted in either direction into the insertion space 34, it is prevented that the mating connector 200 cannot be inserted in either direction due to the chamfers arranged on the metal shell 3, and the use by users is prevented from being affected.

(4) A spacing exists between the stopping portion 332 and each of the front edge and rear edge of the chamfer, and thereby punching force is prevented from deforming the front edge of the metal shell 3 during punching to affect the insertion of the mating connector 200 when the stopping portions 332 are formed by punching.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for insertion with a mating connector, the mating connector having a shielding shell, and the electrical connector comprising:

an insulating body having a base and a tongue extending forward from the base;

a plurality of terminals fixed in the base and extending to the tongue; and a metal shell fixed on the base and defining an insertion space between the metal shell and the tongue for receiving the mating connector, wherein the metal shell comprises two first walls arranged oppositely along an upper side and a lower side, two second walls arranged oppositely along a left side and a right side, and a limiting surface connected with each of the first walls and corresponding one of the second walls; and wherein when the mating connector is inserted in the insertion space, a first distance exists between each first wall and the shielding shell, a second distance exists between each second wall and the shielding shell, a third distance exists between each limiting surface and the shielding shell, and the third distance is less than the first distance and the second distance.

2. The electrical connector of claim 1, wherein each of the limiting surfaces is a chamfer, and the chamfer forms a same angle with corresponding one of the first walls and corresponding one of the second walls.

3. The electrical connector of claim 2, wherein the four chamfers are arranged symmetrically relative to a horizontal central surface of the metal shell, and the third distance is a distance between a central point of each chamfer and the shielding shell.

4. The electrical connector of claim 1, wherein each of the limiting surfaces comprises a chamfer and a stopping portion protruding toward the insertion space from the chamfer, two ends of the chamfer are respectively connected to corresponding one of the first walls and corresponding one of the second walls, the stopping portion is located on a central line of the chamfer, and the third distance exists between the stopping portion and the shielding shell.

5. The electrical connector of claim 4, wherein each of the stopping portions has a shape of a long strip, and a spacing exists between the stopping portion and each of a front edge and a rear edge of the chamfer.

6. The electrical connector of claim 1, wherein a first chamfer and a second chamfer are connected with each other to form each of the limiting surfaces, one end of the first chamfer away from the second chamfer is connected to corresponding one of the first walls, one end of the second chamfer away from the first chamfer is connected to corresponding one of the second walls, an angle between the first chamfer and the corresponding one of the first walls is equal to an angle between the second chamfer and corresponding one of the second walls, and the third distance exists between each of the first chamfer and the second chamfer and the shielding shell.

7. The electrical connector of claim 6, wherein the two first walls are horizontally arranged and are parallel to each other, the two second walls are vertically arranged and are parallel to each other, and a height of each of the first chamfer and the second chamfer in a vertical direction is greater than a height of corresponding one of the second walls.

8. The electrical connector of claim 1, wherein each of the limiting surfaces comprises an arc-shaped surface and at least one stopping portion protruding toward the insertion space from the arc-shaped surface, two ends of the arc-shaped surface are respectively connected to corresponding one of the first walls and corresponding one of the second walls, and the third distance exists between the stopping portion and the shielding shell.

9. The electrical connector of claim 8, wherein each of the arc-shaped surfaces is provided with two stopping portions protruding toward the insertion space, the two stopping portions are respectively located at a joint between the arc-shaped surface and the corresponding one of the first walls and a joint between the arc-shaped surface and the corresponding one of the second walls, and the third distance exists between each of the stopping portions and the shielding shell.

10. The electrical connector of claim 9, wherein each of the stopping portions is arc-shaped, and a distance between each of the stopping portions and the shielding shell is zero.

11. The electrical connector of claim 10, further comprising an external metal shell wrapping a periphery of the metal shell, each of two sides of the external metal shell is provided with a fastening hole, each of two sides of the metal shell is provided with an elastic piece corresponding to one of the fastening holes, the elastic pieces are respectively fastened in the fastening holes, and the stopping portions are each located in front of corresponding one of the elastic pieces.

12. The electrical connector of claim 1, wherein the terminals are respectively arranged on an upper surface and a lower surface of the tongue to form an upper row of terminal group and a lower row of terminal group, the upper row of terminal group and an upper insulating block are formed as a whole by embedding, the lower row of terminal group and a lower insulating block are formed as a whole by embedding, a shielding sheet is clamped between the upper insulating block and the lower insulating block, and the upper row of terminal group, the shielding sheet and the lower row of terminal group are fixed along with the insulating body as a whole in an embedding forming manner.

13. The electrical connector of claim 12, wherein each of two sides of the tongue is recessed with a fastening slot, each of two sides of the shielding sheet is recessed with a recessed portion, and the recessed portions are correspondingly located at the fastening slots and aligned with the fastening slots in a vertical direction.

* * * * *